US011419189B2

(12) United States Patent
Kim et al.

(10) Patent No.: US 11,419,189 B2
(45) Date of Patent: Aug. 16, 2022

(54) INDUCTION HEATING DEVICE AND METHOD FOR CONTROLLING INDUCTION HEATING DEVICE

(71) Applicant: LG ELECTRONICS INC., Seoul (KR)

(72) Inventors: Hanna Kim, Seoul (KR); Shinjae Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 752 days.

(21) Appl. No.: 16/263,109

(22) Filed: Jan. 31, 2019

(65) Prior Publication Data

US 2019/0268979 A1 Aug. 29, 2019

(30) Foreign Application Priority Data

Feb. 26, 2018 (KR) ..... 10-2018-0022855

(51) Int. Cl.
*H05B 6/12* (2006.01)
*H05B 6/06* (2006.01)

(52) U.S. Cl.
CPC ..... *H05B 6/1263* (2013.01); *H05B 6/062* (2013.01); *H05B 2213/04* (2013.01); *H05B 2213/05* (2013.01); *H05B 2213/07* (2013.01)

(58) Field of Classification Search
CPC .. H05B 6/062; H05B 6/1209; H05B 2213/07; H05B 6/1263; H05B 2213/04; H05B 2213/05
USPC ..... 219/620, 622, 624, 626, 429, 441, 489, 219/492, 494, 497, 501, 506, 518
See application file for complete search history.

(56) References Cited

U.S. PATENT DOCUMENTS

2012/0132647 A1* 5/2012 Beverly ..... H05B 6/062 219/624
2015/0373787 A1* 12/2015 Visher ..... H05B 6/062 219/622
2017/0067648 A1* 3/2017 Norman ..... G01J 5/0003

FOREIGN PATENT DOCUMENTS

| | | |
|---|---|---|
| EP | 1 672 959 | 6/2006 |
| EP | 2 555 586 | 2/2013 |
| JP | 2010-092679 | 4/2010 |
| KR | 10-2006-0096452 | 9/2006 |
| KR | 10-2016-0025170 | 3/2016 |
| KR | 10-2016-0096289 | 8/2016 |

OTHER PUBLICATIONS

European Search Report dated Jun. 28, 2019.
Korean Office Action dated Feb. 25, 2019.

* cited by examiner

*Primary Examiner* — Phuong T Nguyen
(74) *Attorney, Agent, or Firm* — KED & Associates LLP

(57) ABSTRACT

An induction heating device capable of preventing a fuse breaking phenomenon that occurs when a user preheats an empty vessel by determining whether or not a load is present in the vessel, and a method for controlling an induction heating device. In order to prevent a rapid rise in temperature of a vessel occurring in process during which a user preheats an empty vessel using an induction heating device and a fuse breaking phenomenon resulting therefrom, a controller of the induction heating device may determine whether or not a vessel placed on a working coil is an empty vessel in a vessel heating process, that is, whether or not a load is present in the vessel.

15 Claims, 10 Drawing Sheets

INDUCTION HEATING DEVICE AND METHOD FOR CONTROLLING INDUCTION HEATING DEVICE

CROSS-REFERENCE TO RELATED APPLICATION(S)

This application claims priority under 35 U.S.C. § 119 to Korean Application No. 10-2018-0022855, filed in Korea on Feb. 26, 2018, whose entire disclosure is herein incorporated by reference.

BACKGROUND

1. Field

An induction heating device and a method for controlling an induction heating device are disclosed herein.

2. Background

Various types of cooking utensils are being used to heat food or other items (hereinafter, collectively "food") in homes and restaurants. Conventionally, gas ranges using gas as a fuel have come into wide use. However, recently, devices for heating a vessel, for example, a cooking vessel such as a cooking pot, using electricity without using gas have come into use.

A method of heating a vessel using electricity is divided into a resistance heating method and an induction heating method. The resistance heating method is a method of heating a vessel by transferring heat generated when a current is passed through a metal-resistant wire or a non-metallic heating element, such as silicon carbide, to the vessel through radiation or conduction. The induction heating method is a method of generating an eddy current in a vessel that is made of a metal component using a magnetic field that occurs around a working coil when a predetermined magnitude of high-frequency power is applied to the working coil so that the vessel itself is heated.

A principle of the induction heating method will be described in more detail hereinafter. First, as power is applied to the induction heating device, a predetermined magnitude of high-frequency voltage is applied to the working coil. Accordingly, an induction magnetic field occurs around the working coil disposed in the induction heating device. When a magnetic line of force of the induction magnetic field passes through a bottom of the vessel including a metal component which is placed on the induction heating device, an eddy current occurs in the bottom of the vessel. When the eddy current flows through the bottom of the vessel, the vessel itself is heated.

In order to prevent a phenomenon in which the vessel is overheated which may occur during use of the induction heating device, the induction heating device according to the related art is provided with a temperature sensor. The induction heating device performs temperature control to prevent the vessel from being overheated according to a temperature of the vessel measured through the temperature sensor. In addition, in order to prevent the phenomenon in which the vessel is overheated, a fuse may be provided in addition to the temperature sensor. For example, Korean Patent Application Publication No. 10-2016-0025170, which is hereby incorporated by reference, discloses an induction heating device provided with a temperature sensor and a fuse.

FIG. 1 is a graph showing a temperature change with respect to time when heating a vessel in which a load is present using an induction heating device according to the related art. FIG. 2 is a graph showing a temperature change with respect to time when heating an empty vessel in which no load is present using an induction heating device according to the related art.

First, as shown in FIG. 1, when a vessel in which a load, for example, water, or oil, is present is placed on the induction heating device and then the vessel is heated, a temperature of the vessel rises with time. In this case, when the vessel is continuously heated even after a boiling point of the load present in the vessel has been reached, the temperature of the vessel continuously rises.

When the temperature of the vessel continuously rises by continuously heating the vessel, food in the vessel may overflow or may be burned, and a fire may occur. Therefore, the induction heating device according to the related art sets an upper limit temperature TB to limit a temperature rise of the vessel, and cuts off power supply to a working coil when the temperature of the vessel reaches the upper limit temperature TB. Then, as shown in FIG. 1, the temperature of the vessel does not rise from a power supply cutoff time point P1, and gradually decreases with time.

Also, the induction heating device according to the related art is provided with a fuse that is broken according to the temperature of the vessel as described above. The fuse provided in the conventional induction heating device is connected between an external power source and a power supply unit, and has a characteristic of being broken when a breaking temperature TA is reached. Accordingly, even when the temperature of the vessel instantaneously exceeds the upper limit temperature TB and reaches the breaking temperature TA due to failure to cut off the power supply to the working coil, the fuse is broken, thereby cutting off the power supply to the working coil and stopping the vessel from being heated.

However, when the user places the vessel on the induction heating device without putting a load into the vessel so as to preheat the vessel, the temperature of the vessel rises sharply as compared with a case in which a load is present in the vessel. In this case, the temperature of the vessel rises sharply up to the upper limit temperature TB as shown in FIG. 2.

Accordingly, as described above, the power supply to the working coil is cut off at a time point P2 when the temperature of the vessel reaches the upper limit temperature TB, and thus, a heating operation is stopped. However, the temperature of the vessel continuously rises due to heat energy remaining in the already heated vessel. Then, as shown in FIG. 2, the temperature of the vessel continuously rises, and consequently reaches the breaking temperature TA at a time point P3. As a result, the fuse connected between the external power source and the power supply unit is broken.

In the final analysis, according to the related art, in a process during which a user preheats an empty vessel using the induction heating device, the fuse provided in the induction heating device is broken due to a rapid rise in the temperature of the vessel. As a result, there is a problem that the induction heating device cannot be used until the fuse is replaced.

BRIEF DESCRIPTION OF THE DRAWINGS

Embodiments will be described in detail with reference to the following drawings in which like reference numerals refer to like elements, and wherein.

DETAILED DESCRIPTION

Figure 1:
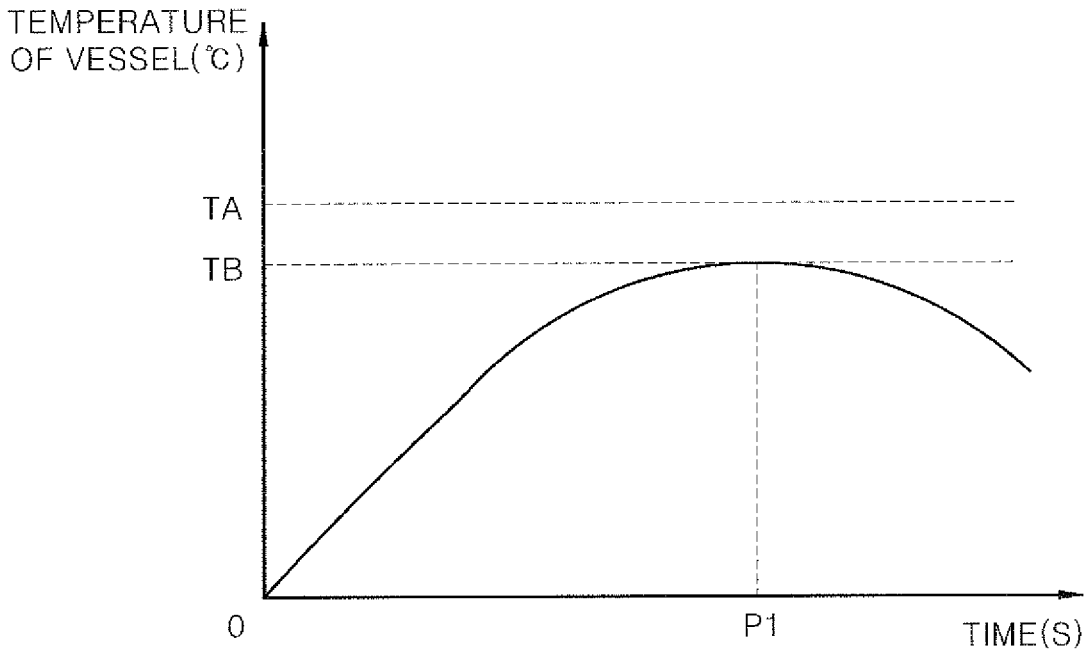
FIG. 1 is a graph showing a temperature change with respect to time when heating a vessel in which a load is present using an induction heating device according to the related art.
Figure 2:
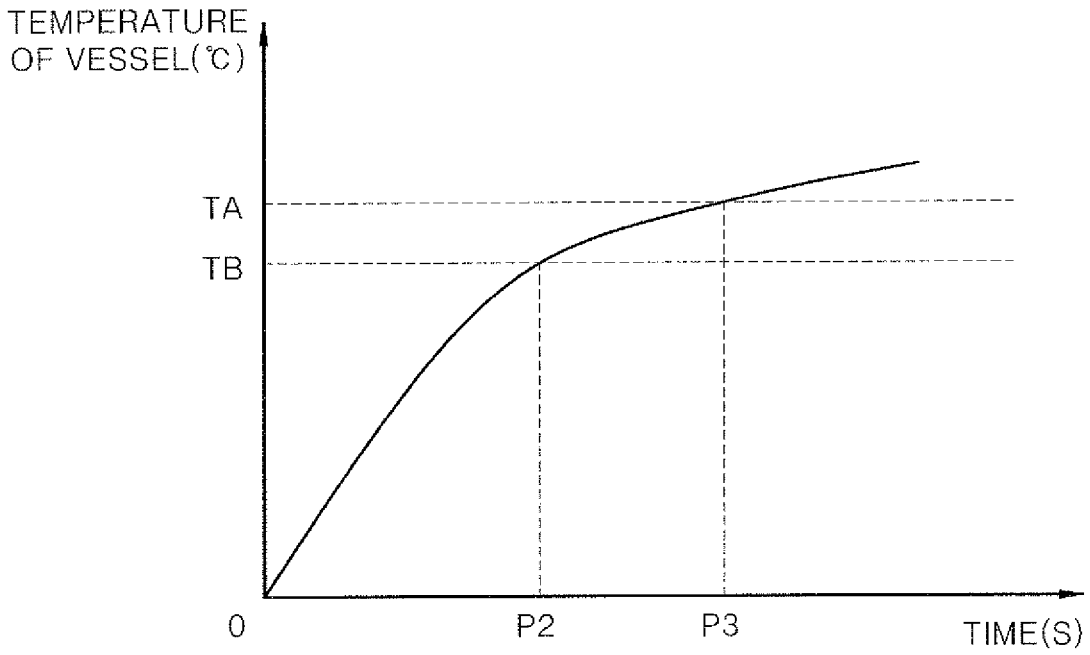
FIG. 2 is a graph showing a temperature change with respect to time when heating an empty vessel in which no load is present using an induction heating device according to the related art.

The aforementioned objects, features, and advantages will be described in detail with reference to the accompanying drawings, such that those skilled in the art can easily carry out a technical idea. In the description of embodiments, the detailed description of well-known related configurations or functions will be omitted when it is deemed that such description will cause ambiguous interpretation. Hereinafter, embodiments will be described with reference to the accompanying drawings. In the drawings, the same or like reference numerals designate the same or like elements, and repetitive disclosure has been omitted.

Figure 3:
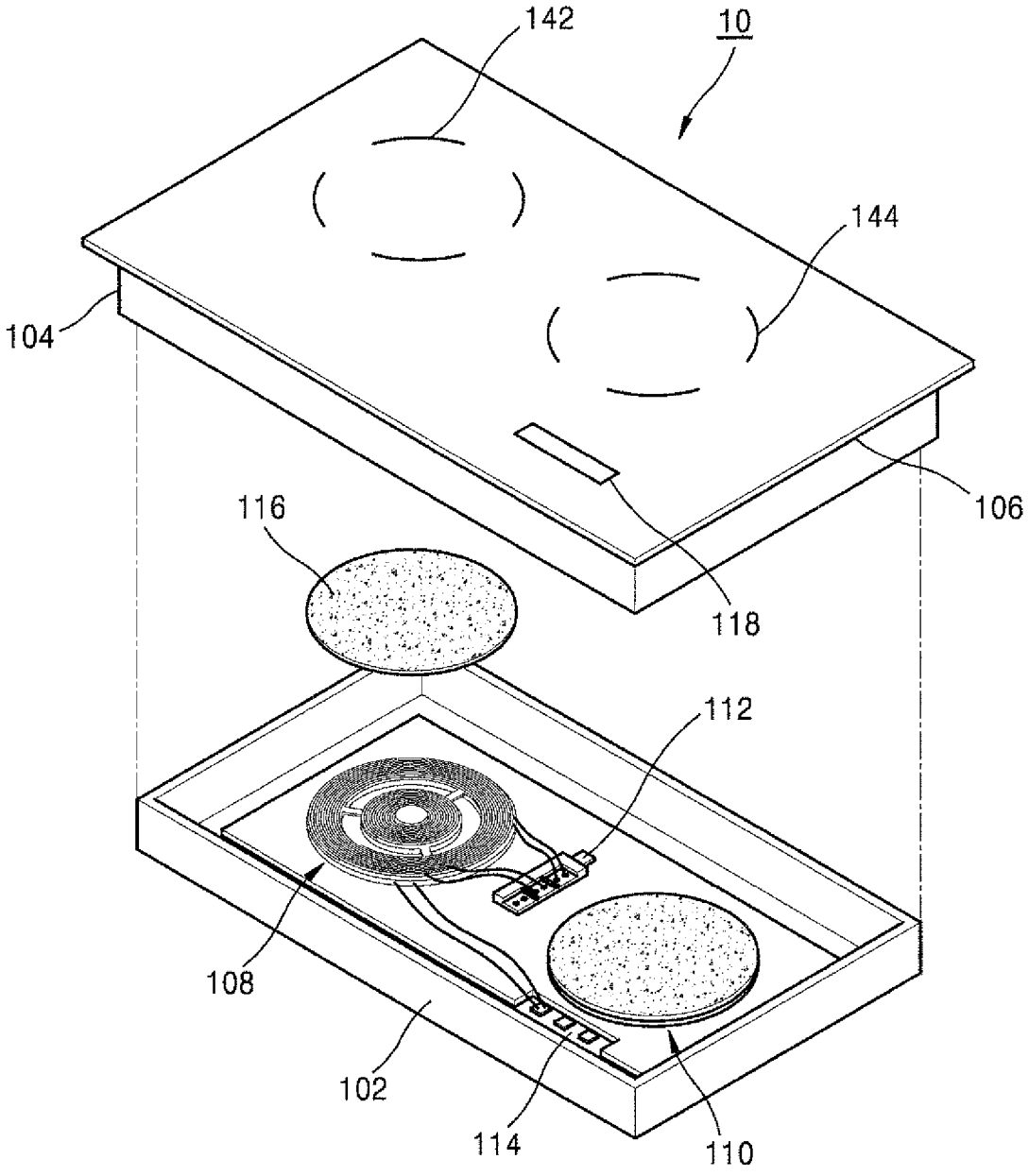
FIG. 3 is a perspective view of an induction heating device according to an embodiment.

FIG. 3 is a perspective view of an induction heating device according to an embodiment. Referring to FIG. 3, induction heating device 10 according to an embodiment may include a case 102 constituting a main body and a cover plate 104 coupled to the case 102 to seal the case 102.

A lower surface of the cover plate 104 may be coupled to an upper surface of the case 102 to seal a space formed inside the case 102 from an outside. An upper surface of the cover plate 104 may be provided with an upper plate portion or plate 106 on which a vessel for cooking food or other items (hereinafter, collectively "food") may be placed. The upper plate 106 may be made of various materials, for example, a tempered glass material such as ceramic glass.

Working coil assemblies 108 and 110 configured to heat a vessel may be disposed in an inner space of the case 102 formed by the cover plate 104 and the case 102 which may be coupled to each other. In order to allow a location of the vessel to correspond to respective locations of the working coil assemblies 108 and 110 when the user places the vessel on the cover plate 104, burner areas 142 and 144 may be displayed on the upper plate portion 106 of the cover plate 104 at locations corresponding to the locations of the working coil assemblies 108 and 110 disposed in the inner space of the case 102.

The inner space of the case 102 may also be provided with an interface unit 114 configured to allow the user to apply power, adjust outputs of the working coil assemblies 108 and 110, or display information related to the induction heating device 10. Hereinafter, embodiments will be described on the basis of an embodiment in which the interface unit 114 is implemented as a touch panel capable of both inputting information by touch and displaying the information; however, the interface unit 114 may be implemented in other forms or structures.

The upper plate portion 106 of the cover plate 104 may be provided with a control area 118 at a location corresponding to the interface unit 114. In the control area 118, a specific character, or image, for example, for a user's operation or information display may be displayed. The user may perform a desired control by controlling, for example, touching, a specific point in the control area 118 with reference to the characters or images displayed on the control area 118. In addition, various kinds of information output by the interface unit 114 according to control of the user or an operation of the induction heating device 10 may be displayed through the control area 118.

A power unit 112 configured to supply power to the working coil assemblies 108 and 110 or the interface unit 114 may be disposed in the inner space of the case 102. The power unit 112 may be electrically connected to the working coil assemblies 108 and 110 or the interface unit 114, and may convert power supplied from an external power source into power suitable for driving the working coil or the interface unit 114 and supply the converted power to the working coil or the interface unit 114.

For reference, FIG. 1 shows an embodiment in which two working coil assemblies 108 and 110 are disposed in the inner space of the case 102. However, in some embodiments, one working coil assembly may be disposed in the inner space of the case 102 or two or more working coil assemblies may be disposed in the inner space of the case 102.

The working coil assemblies 108 and 110 each may include a working coil configured to form an induction magnetic field using a high-frequency alternating current (AC) supplied by the power unit 112 and a heat insulating sheet 116 laminated on the working coil to protect the coil from heat generated by an object to be heated. In some embodiments, the heat insulating sheet 116 may be omitted.

Further, although not shown in FIG. 1, a controller (not shown) may be disposed in the inner space of the case 102. The controller (not shown) may control driving of the power unit 112 according to a user command input through the interface unit 114 to control power supply to the working coil, that is, a heating operation for the vessel.

Figure 4:
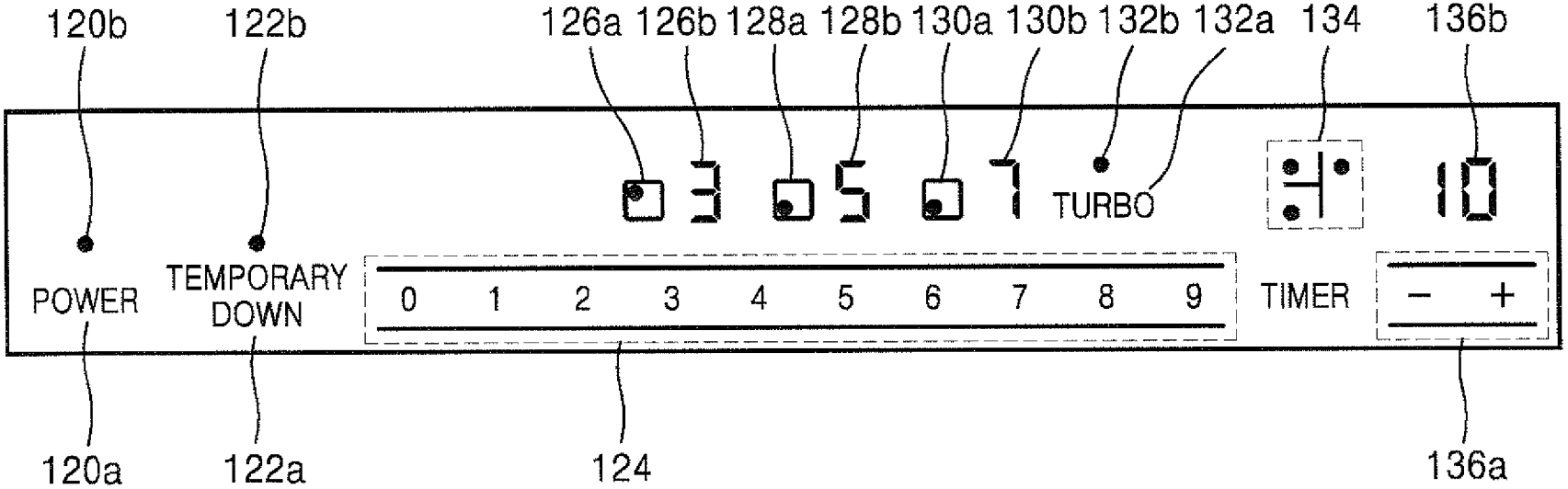
FIG. 4 is a view showing a control area of an induction heating device according to an embodiment.

FIG. 4 is a view showing a control area of an induction heating device according to an embodiment. For reference, the embodiment of the control area shown in FIG. 4 is applicable when the interface unit 114 is implemented as a touchable and displayable touch panel. When the interface unit 114 is implemented in other forms or structures, the control area may be also implemented in other forms or structures.

Referring to FIG. 4, the control area may include touch areas 120*a*, 122*a*, 124, 132*a*, and 136*a* that can be touched by the user for control of the induction heating device, and display areas 126*b*, 128*a*, 128*b*, 130*a*, 130*b*, 132*b*, 134, and 136*b* configured to display various kinds of information according to the control of the user or the operation of the induction heating device.

The user may touch a power button 120*a* to apply power to the induction heating device or cut off the power. A power lamp 120*b* may be turned on or off according to the user's operation of touching the power button 120*a*. Also, the user may also lower an output level of the induction heating device to a predetermined level, for example, 1 or 2, by touching a temporary down button 122*a* when the induction heating device is being driven at a specific output level. A temporary down lamp 122*b* may be turned on or off according to an operation of touching the temporary down button 122*a*.

After touching the power button 120*a* to apply power to the induction heating device, the user may touch burner selection buttons 126*a*, 128*a*, and 130*a* to select a burner that the user intends to adjust an output level, and then may touch an output level adjustment button 124 to set a desired output level (0 to 9). As a numeral of the output level increases, a magnitude of current applied to the working coil may increase and more heat energy may occur in the vessel. When the user touches the output level adjustment button 124, the output level set by the user may be displayed as a numeral on the burner output level display area 126*b*, 128*b* or 130*b* corresponding to the burner selected by the user.

When the user touches a turbo button 132*a*, a turbo lamp 132*b* may be turned on, and accordingly, the output level of the induction heating device may be set to a turbo level, that is, a maximum level. When the user touches the output level adjustment button 124 in a state in which the output level of the induction heating device is set to turbo, the turbo lamp 132*b* may be turned off.

The burner display unit 134 may display a burner that is performing a heating operation by the user's operation, among the burners included in the induction heating device. Also, the user may touch a timer button 136*a* to set a timer. When the user touches a + or − button of the timer button 136*a*, a numeral of the timer display area 136*b* may increase or decrease according to a predetermined time interval, for example, 5 minutes. When timer settings are completed, the timer may be activated. After time corresponding to a numeral displayed on the timer display 136*b*, for example, 10 minutes, has elapsed, the power supply to the working coil may be cut off.

Figure 5:
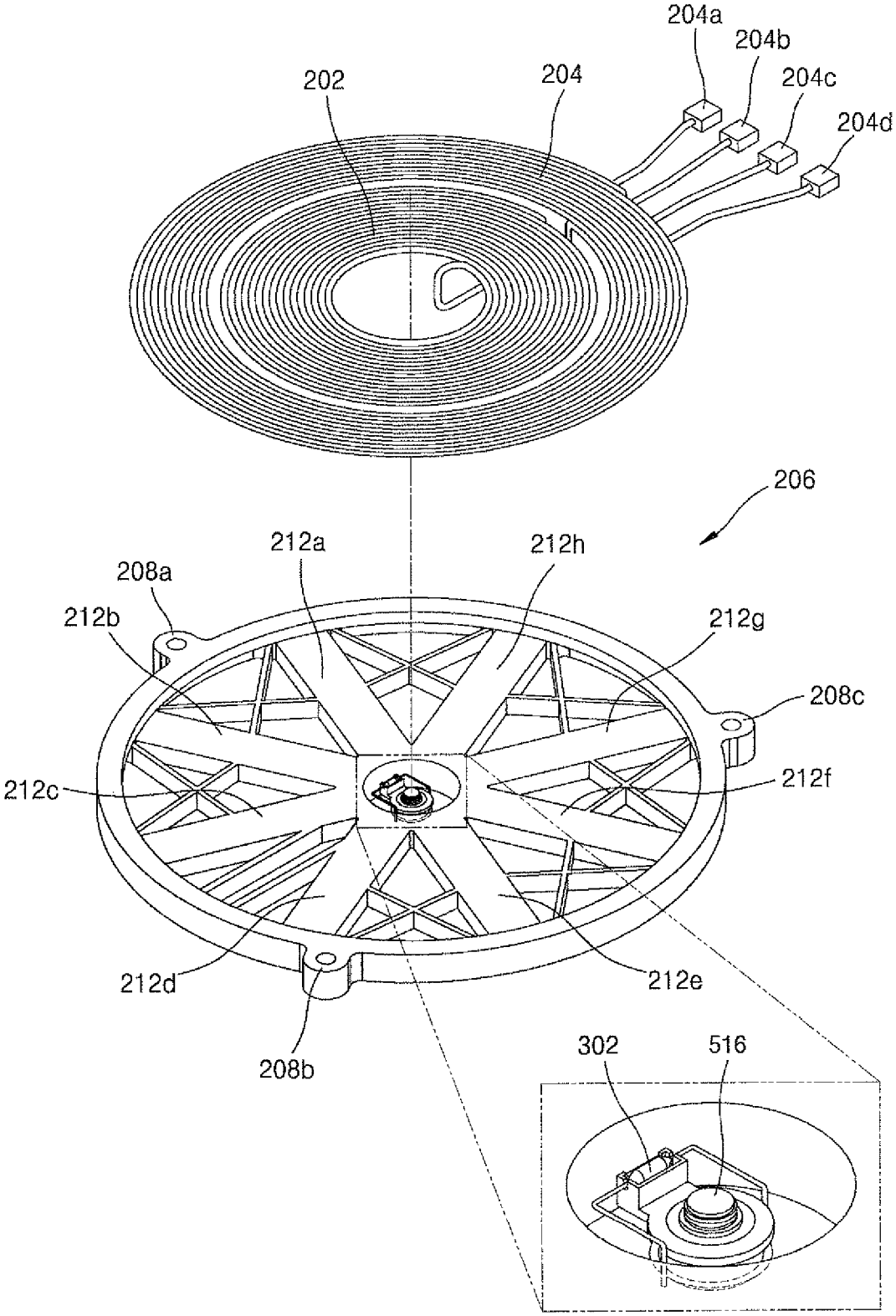
FIG. 5 is a perspective view showing an upper portion of a working coil assembly included in an induction heating device according to an embodiment.
Figure 6:
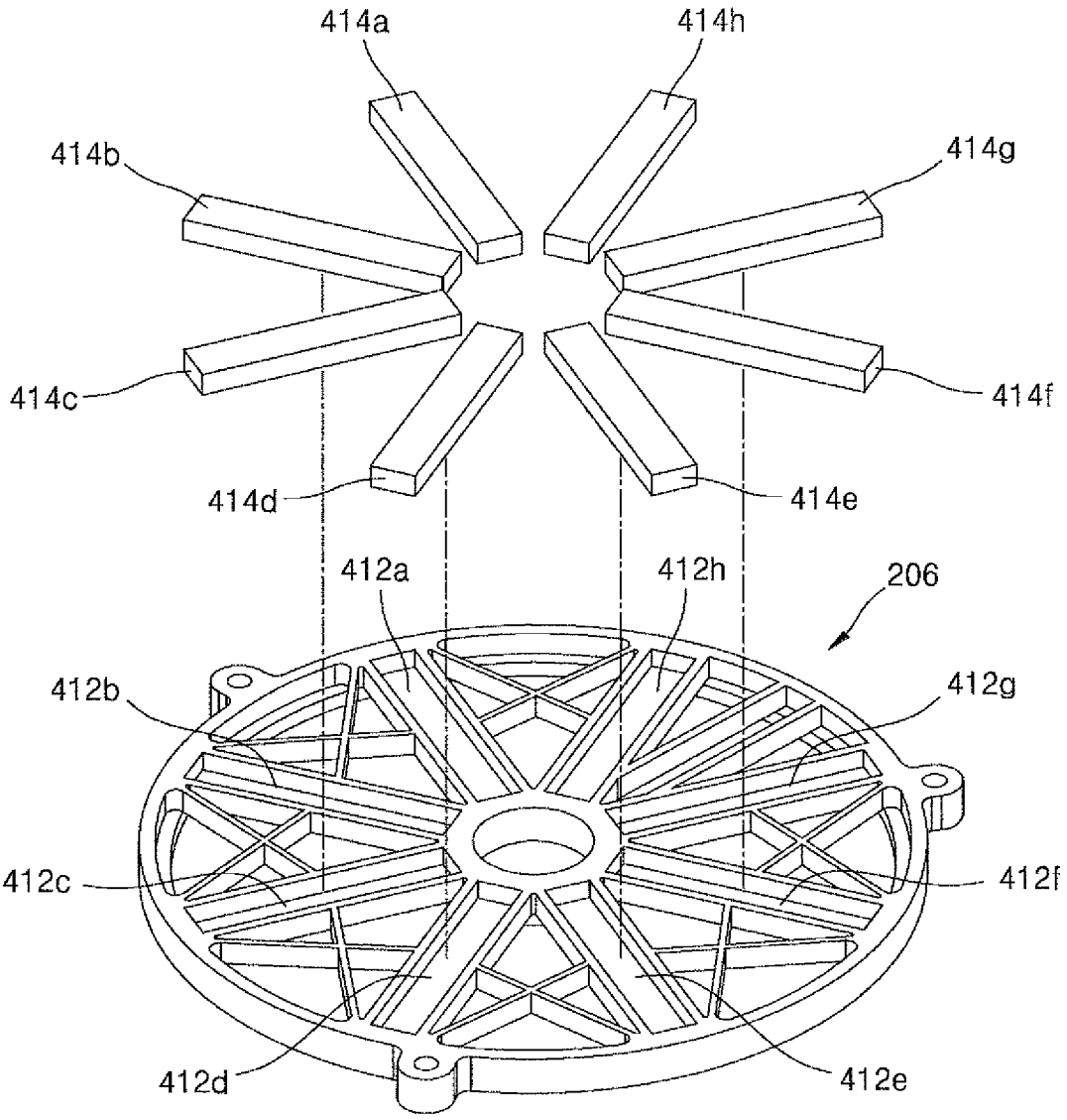
FIG. 6 is a perspective view showing a lower portion of the working coil assembly shown in FIG. 5.

FIG. 5 is a perspective view showing an upper portion of a working coil assembly included in an induction heating device according to an embodiment. FIG. 6 is a perspective view showing a lower portion of the working coil assembly shown in FIG. 5.

Referring to FIGS. 5 and 6, the working coil assembly according to an embodiment may include a first working coil 202, a second working coil 204, and a coil base 206. The coil base 206 may have a shape corresponding to the first working coil 202 and second working coil 204, for example, a circular or square shape as a structure for accommodating and supporting the first and second working coils 202 and 204, and may be made of a non-conductive material. A lower end of an area where the first working coil 202 and the second working coil 204 are accommodated in the coil base 206 may be provided with accommodating units 212*a* to 212*h* configured to accommodate a magnetic body, for example, a ferrite sheet described hereinafter.

At least one of fixing units 208*a*, 208*b*, and 208*c* configured to fix the coil base 206 to the inner space of the case 102 shown in FIG. 1 may be formed around the coil base 206. The fixing units 208*a*, 208*b*, and 208*c* may be provided with holes into which fixing structures for fixing the coil base 206 to the inner space of the case 102 may be inserted.

An accommodating space for accommodating a temperature sensor 516 and a fuse 302 may be formed at a center of the coil base 206. The temperature sensor 516 and the fuse 302 may be disposed to be close to or in contact with the lower surface of the cover plate 104 when the cover plate 104 and the case 102 of FIG. 1 are coupled to each other. Accordingly, when the vessel is placed at a location corresponding to the coil base 206, a temperature of the vessel may be measured through the temperature sensor 516. Further, when the temperature of the vessel reaches a breaking temperature of the fuse 302 in the vessel heating process, the fuse 302 may be broken.

Referring again to FIGS. 5 and 6, the first working coil 202 may be mounted on the coil base 206 and may be wound in a radial direction by a first number of rotations. Further, the second working coil 204 may be mounted on the coil base 206, may share a center with the first working coil 202, and may be wound in a radial direction by a second number of rotations.

The number of rotations of the first working coil 202 and the number of rotations of the second working coil 204 may vary according to an embodiment. A sum of the number of rotations of the first working coil 202 and the number of rotations of the second working coil 204 may be limited by a size of the coil base 206 and a specification of the induction heating device. Also, FIGS. 4 and 5 show an embodiment in which two working coils 202 and 204 are accommodated in one coil base 206. However, the number of working coils accommodated in one coil base 206 may vary according to an embodiment Referring again to FIGS. 5 and 6, opposite ends of the first working coil 202 and opposite ends of the second working coil 204 may extend to opposite ends of the first working coil 202 and an outside of the second working coil 204, respectively. Connectors 204*a* and 204*b* may be connected to the opposite ends of the first working coil 202 and connectors 204*c* and 204*d* may be connected to the opposite ends of the second working coil 204. The first and second working coils 202 and 204 may be electrically connected to a controller (not shown) or a power supply unit (not shown) through the connectors 204*a*, 204*b*, 204*c*, and 204*d*. In some embodiments, the connectors 204*a*, 204*b*, 204*c*, and 204*d* may be implemented as a conductive connection terminal.

In addition, a lower portion of the coil base 206 may be provided with accommodating units 412*a* to 412*h* configured to accommodate magnetic bodies, for example, ferrite sheets 414*a* to 414*h*. The ferrite sheets 414*a* to 414*h* may prevent magnetic fluxes generated by the first and second working coils 202 and 204 from being formed in a lower direction of the coil base 206, thereby increasing densities of the magnetic fluxes generated by the first and second working coils 204 and 204. The respective ferrite sheets 414*a* to 414*h* may be disposed in a radial direction of the first and second working coils 202 and 204. For reference, the number, shape, location, and cross-sectional area, for example, of the ferrite sheet may vary according to an embodiment.

Figure 7:
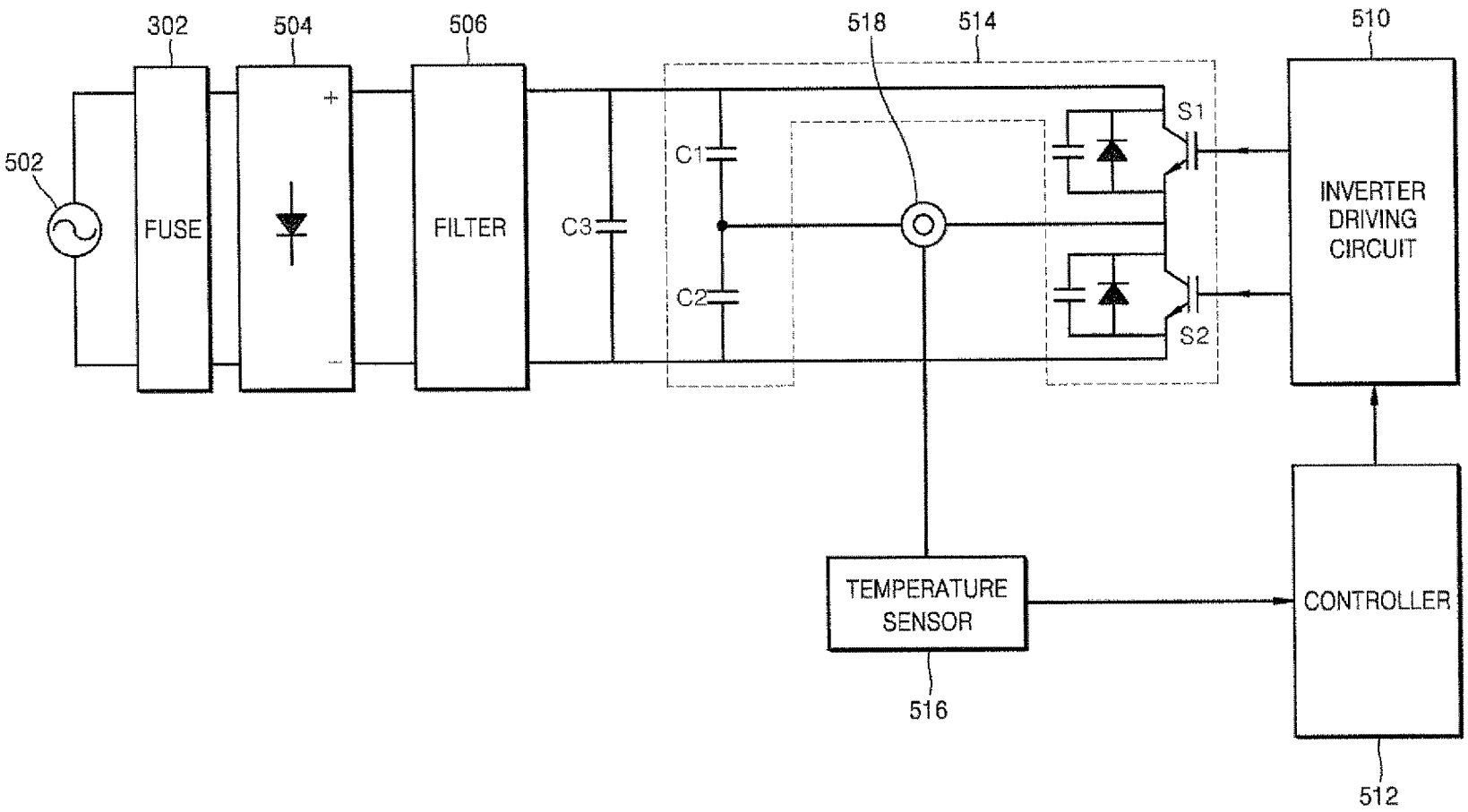
FIG. 7 is a view showing a circuit configuration of an induction heating device according to an embodiment.

FIG. 7 is a view showing a circuit configuration of an induction heating device according to an embodiment. Referring to FIG. 7, the induction heating device according to an embodiment may include fuse 302, a rectification unit 504, a filter 506, a power supply unit 514, a working coil 518, an inverter driving circuit 510, and a controller 512.

The fuse 302 may be electrically connected between an external power source 502 and the rectification unit 504, and may be disposed to be close to or in contact with the lower surface of the cover plate 104 as previously described with reference to FIG. 4. The fuse 302 may be broken when the temperature of the fuse 302 rising due to the temperature of the vessel rising in the vessel heating process reaches a specific temperature, that is, the breaking temperature. A connection location of the fuse 302 may vary according to an embodiment.

The rectification unit 504 may rectify and output AC power supplied by the external power source 502. The filter 506 may remove an AC component remaining in direct current (DC) power rectified by the rectification unit 504. In some embodiments, the filter 506 may be omitted.

The power output by the rectification unit 504 and the filter 506 may be input to a smoothing capacitor C3. The smoothing capacitor C3 may smooth the power output by the rectification unit 504 and the filter 506 to generate DC power.

The power supply unit 514 may supply an AC for the heating operation of the working coil 518 using the DC power output from the smoothing capacitor C3. The power supply unit 514 may include two capacitors C1 and C2 connected in series with each other and two switching elements S1 and S2 connected in series with each other.

The first switching element S1 and the second switching element S2 may be alternately turned on and off according to a switching signal supplied from the inverter driving circuit 510. The alternate turn-on and turn-off operations of the first switching element S1 and the second switching element S2 are referred to as a "switching operation". The DC power output from the smoothing capacitor C3 may be converted into an AC by the switching operations of the first switching element S1 and the second switching element S2, and may be supplied to the working coil 518. A magnitude of the AC supplied to the working coil 518 may be proportional to an output level set by the user through the output level adjustment button 124 of FIG. 4.

The controller 512 may receive the output level set by the user through the output level adjustment button 124 of FIG. 4, and may supply a current command value corresponding to the output level set by the user to the inverter driving circuit 510. The inverter driving circuit 510 may generate a switching signal corresponding to the current command value supplied from the controller 512 and may apply the switching signal to each of the first switching element S1 and the second switching element S2. Accordingly, the switching operations of the first switching element S1 and the second switching element S2 as described above may be performed.

Further, the controller 512 may also determine whether or not the vessel is an empty vessel based on the temperature of the vessel placed on the working coil 518 measured through the temperature sensor 516, and may control the power supply to the working coil 518 performed by the power supply unit 514 according to a result of determination.

The controller 512 may determine whether or not the vessel is an empty vessel based on the vessel determination time which is the time required for the temperature of the vessel measured by the temperature sensor 516 to reach the second reference temperature from the first reference temperature. Also, when it is determined that the vessel is an empty vessel, the controller 512 may stop the vessel heating operation performed by the working coil 518 by cutting off the power supply 514 to the working coil 518 performed by the power supply unit 514. More specifically, when the vessel determination time is equal to or less than the predetermined reference determination time, the controller 12 may determine that the vessel is an empty vessel, and otherwise, may determine that a load is present in the vessel.

The reference determination time may be set differently according to an output level of the working coil 518. The reference determination time may be defined as a time required for the temperature of the vessel to reach the second reference temperature from the first reference temperature when a predetermined reference load is present in the vessel.

In addition, when it is determined that a load is present in the vessel, the controller may cut off the power supply to the working coil 518 performed by the power supply unit 514 when the temperature of the vessel reaches a third reference temperature, thereby stopping the vessel heating operation performed by the working coil 518. The first reference temperature may be set to be higher than a boiling point of the predetermined reference load.

Hereinafter, a method in which the induction heating device according to an embodiment controls the temperature of the vessel will be described with reference to FIGS. 1 to 9.

Figure 8:
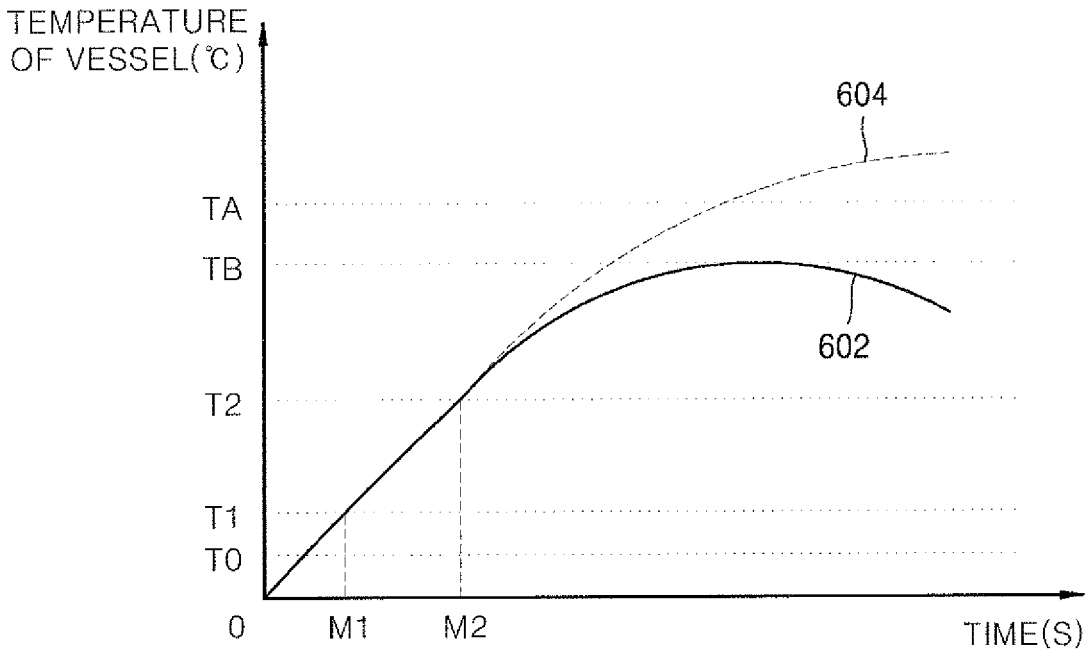
FIG. 8 is a graph showing a temperature change with respect to time when heating a vessel using an induction heating device according to an embodiment.

FIG. 8 is a graph showing a temperature change with respect to time when heating a vessel using an induction heating device according to an embodiment. When the user places the vessel in the burner area 142 formed on the cover plate 106 and applies power by touching the power button 120*a* in the control area, the controller 512 may determine whether or not a heatable vessel is present. For example, when applying a predetermined magnitude of AC to the working coil 518, the controller 512 may compare a magnitude of resonant current flowing through the working coil 518 with a predetermined reference value. Only when the magnitude of resonance current is less than the reference value, the controller 512 may determine that a heatable vessel is present in the burner area 142.

When the user touches the output level adjustment button 124 to set a desired output level in a state in which it is determined that a heatable vessel is present in the burner area 142, the controller 512 may supply the current command value corresponding to the output level set by the user to the inverter driving circuit 510. Accordingly, the inverter driving circuit 510 may supply the switching signal to each of the first switching element S1 and the second switching element S2, and an AC may be supplied to the working coil 518 by the switching operations of the first switching element S1 and the second switching element S2. The supply of the AC may allow the working coil 518 to perform a heating operation on the vessel.

When the heating operation is performed on the vessel placed on the burner area 142 by the working coil 518, the controller may continuously measure the temperature of the vessel placed in the burner area 142 through the temperature sensor 516. In line with the vessel heating operation performed by working coil 518, the temperature of the vessel may continuously rise as shown in FIG. 8. In FIG. 8, T0 indicates a temperature corresponding to the boiling point of the reference load when a predetermined reference load, for example, water, is present in the vessel.

The controller 512 may operate the timer at a time point M1 when the temperature of the vessel reaches a predetermined first reference temperature T1 due to the heating operation for the vessel. Then, at a time point M2 when the temperature of the vessel reaches a predetermined second reference temperature T2, the controller 512 may stop the operation of the timer. In accordance with such an operation, the controller 512 may measure a vessel determination time M2-M1, which is a time required for the temperature of the vessel to reach the second reference temperature T2 from the first reference temperature T1.

When measurement of the vessel determination time is completed, the controller 512 may compare the vessel determination time with a predetermined reference determination time to determine whether or not the vessel which is currently being heated is an empty vessel, in other words, whether or not a load is present in the vessel. When the vessel determination time is equal to or less than the reference determination time as a result of the comparison, the controller 512 may determine that the vessel which is currently being heated is an empty vessel, and otherwise, may determine that a load is present in the vessel which is currently being heated. As described above, the induction heating device according to embodiments may determine whether or not the vessel which is being heated is an empty vessel only with the temperature sensor without adding a separate sensor.

When it is determined that the vessel which is currently being heated is an empty vessel as a result of vessel determination, the controller 512 may cut off the power supply to the working coil 518 by stopping the supply of the current command value to the inverter driving circuit 510. The heating operation for the vessel placed in the burner area 142 may be stopped. Then, as shown in FIG. 8, the temperature of the empty vessel placed in the burner area 142 may rise due to heat energy remaining in the vessel, but the temperature of the empty vessel may not rise to the breaking temperature TA of the fuse 302 and falls again (602).

When the heating operation is continued even though the vessel determination time is equal to or less than the reference determination time at the time point M2, in other words, the vessel which is currently being heated is an empty vessel, or when the heating operation for the vessel is stopped at a time point later than the time point M2, the temperature of the vessel may continuously rise due to the heat energy remaining in the vessel, and consequently may exceed the breaking temperature TA of the fuse 302. Accordingly, when the fuse 302 is broken, the user cannot use the induction heating device until the fuse 302 is replaced.

However, according to the control operation of embodiments as described above, even though the heating operation is performed in a state in which the user places an empty vessel on the burner area 142, that is, an empty vessel is preheated, it may be automatically determined that the vessel which is currently being heated is an empty vessel, and the heating operation may be cut off at the time point M2, thereby preventing the fuse 302 from being unnecessarily broken as in the conventional case.

When it is determined that the vessel which is currently being heated is not an empty vessel as a result of comparing the above-described vessel determination time with the reference determination time, the controller 512 may control the heating operation for the vessel which is being heated to be continuously performed. Even when a load is present in the vessel, the controller 512 may continuously measure the temperature of the vessel. When the measured temperature of the vessel reaches a predetermined third reference temperature TB, the supply of the current command value to the inverter driving circuit 510 may be stopped, thereby cutting off the power supply to the working coil 518. Accordingly, the heating operation for the vessel placed in the burner area 142 may be stopped, thereby preventing the vessel from being overheated.

In embodiments, when a predetermined reference load, for example, water, is present in the vessel, the first reference temperature T1 may be set to be higher than the boiling point T0 of the reference load. This is because a load having a boiling point higher than the reference load may be present. Therefore, by setting the first reference temperature T1 to be higher than the boiling point T0 of the reference load, it is possible to prevent a situation where the heating operation for the vessel is stopped in a state in which a load present in the vessel is not sufficiently boiled.

Also, the second reference temperature T2 may be set so that the temperature of the vessel rising due to the heat energy remaining in the vessel after the heating operation for the vessel is stopped does not reach the breaking temperature TA of the fuse 302. The temperature of the vessel rising after the heating operation for the vessel is stopped may vary according to a material of the vessel, and thus, the second reference temperature T2 may be set experimentally so as to satisfy the conditions above and differently according to a type of the vessel.

Figure 9:
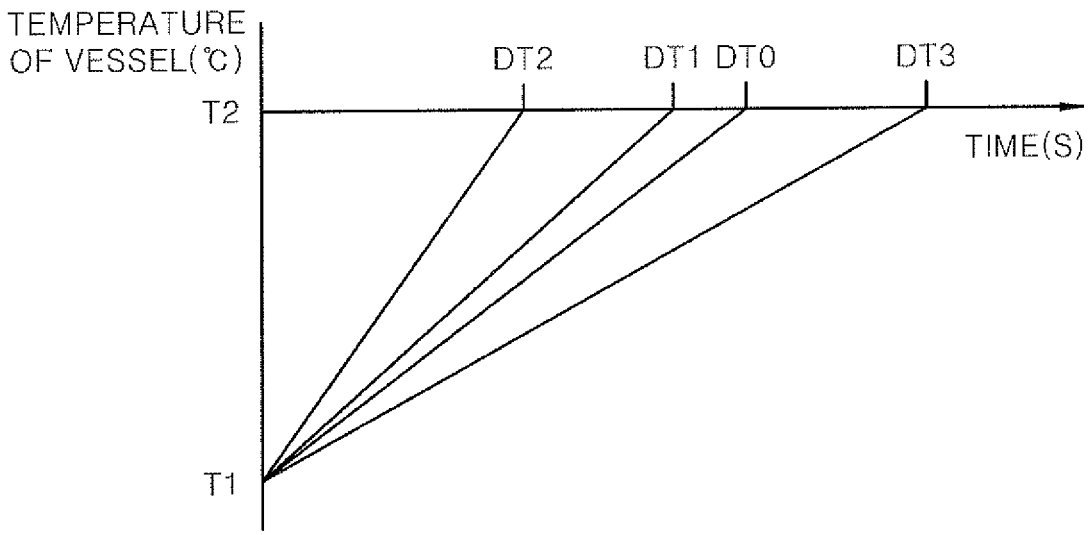
FIG. 9 is a graph showing a reference determination time for vessel determination of an induction heating device according to an embodiment.

FIG. 9 is a graph showing a reference determination time for vessel determination of an induction heating device according to an embodiment. FIG. 9 shows times DT0, DT1, DT2, and DT3 required for the temperature of the vessel which is being heated measured by the temperature sensor 516 to rise from the first reference temperature T1 to the second reference temperature T2, that is, the vessel determination time.

First, the time DT0 indicates a vessel determination time measured by heating the vessel to an output level of 9 when a predetermined reference load, for example, water, is present in the vessel. The time DT3 also indicates a vessel determination time measured by heating the vessel to an output level of 9 when a load having a boiling point higher than that of the reference load, for example, oil, is present in the vessel.

Further, the time DT1 also indicates a vessel determination time measured by heating the vessel to an output level of 9 when no load is present in the vessel. The time DT2 indicates a vessel determination time measured by heating the vessel to an output level of turbo when no load is present in the vessel.

As can be seen from FIG. 9, the vessel determination time measured when no load is present in the vessel may be shorter than that measured when a load is present in the vessel. In other words, when no load is present in the vessel, the temperature may rise at a faster rate than the temperature rises when a load is present in the vessel. On the basis of such a principle, embodiments may determine whether or not the vessel is an empty vessel based on the temperature of the vessel which is being heated.

Also, as shown in FIG. 9, even when the same empty vessel is heated, the vessel determination time may become shorter as the output level is set higher. Therefore, in embodiments, the reference determination times for respective output levels may be set to be different from each other. For example, a reference determination time corresponding to an output level of 9 may be set to 43 seconds, and a reference determination time corresponding to an output level of turbo may be set to 41 seconds. In this way, it is possible to determine the vessel more accurately by setting the reference determination times for respective output levels to be different from each other.

Figure 10:
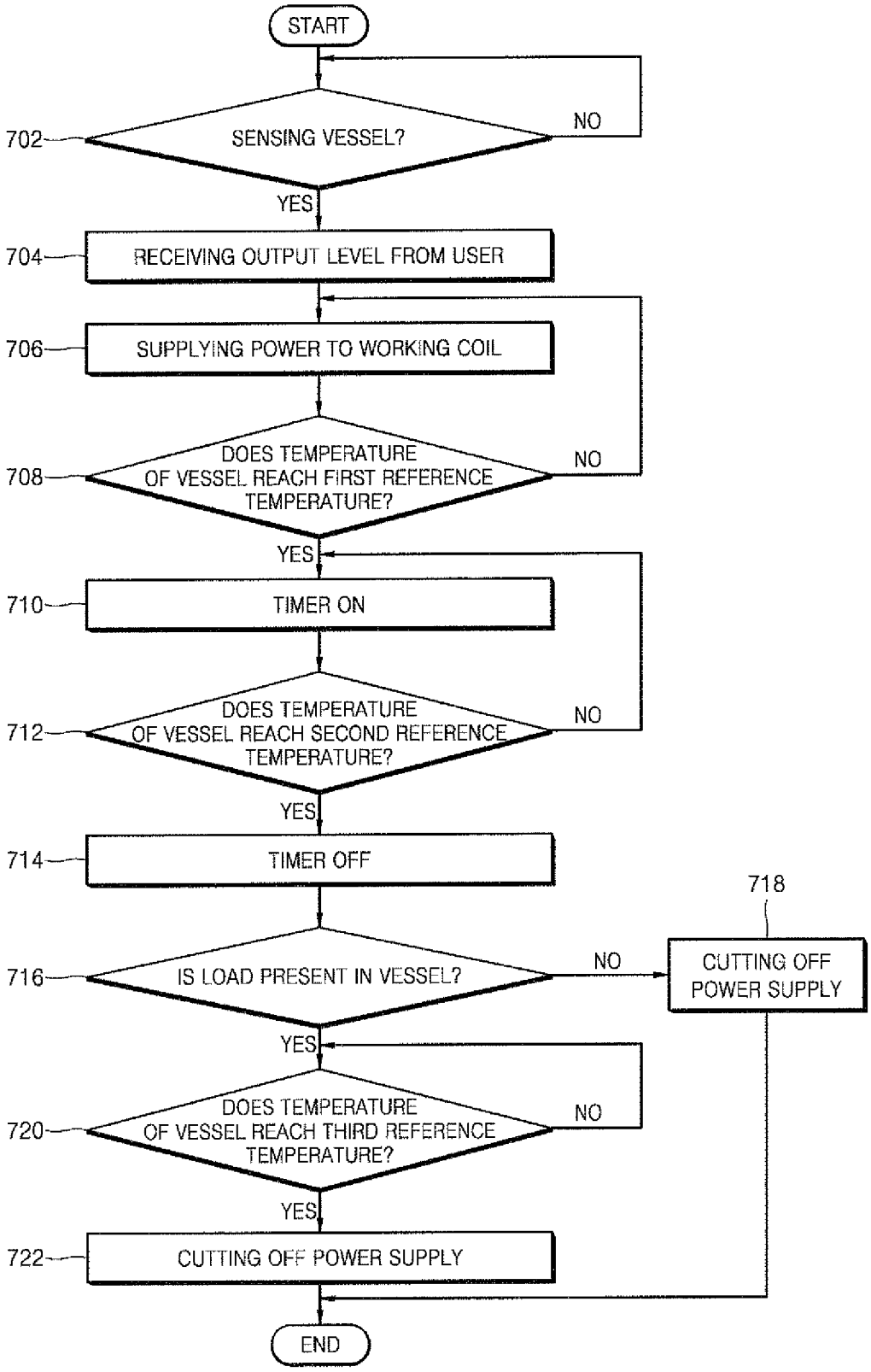
FIG. 10 is a flowchart showing a method for controlling an induction heating device according to an embodiment.

FIG. 10 is a flowchart showing a method for controlling an induction heating device according to an embodiment. Referring to FIG. 10, controller 512 of induction heating device 10 according to an embodiment may firstly sense whether or not a heaterable vessel is placed in a burner area of the induction heating device at step or operation 702. For example, the controller 512 may compare a magnitude of resonance current flowing through the working coil 518 with a reference value when applying a predetermined AC to the working coil 518, thereby determining whether or not a heatable vessel is placed in the burner area.

When it is sensed that a heatable vessel is placed in the burner area, the controller 512 may receive an output level from the user at step or operation 704. The controller 512 may supply power corresponding to the output level set by the user to the working coil 518 in step or operation 706 to allow the working coil 518 to perform the vessel heating operation.

The controller 512 may measure a temperature of the vessel through temperature sensor 516 while the heating operation is performed on the vessel. The controller 512 may check whether or not the temperature of the vessel which is currently being heated reaches a first reference temperature at step or operation 708.

When the temperature of the vessel has not reached the first reference temperature as a result of the checking at step or operation 708, the controller 512 may supply power to the working coil 518 to continue the heating operation. When the temperature of the vessel has reached the first reference temperature as a result of checking at step 708, the controller 512 may drive a timer to measure an elapsed time in step or operation 710.

Thereafter, the controller 512 may check whether or not the temperature of the vessel which is currently being heated has reached a second reference temperature at step or operation 712. When the temperature of the vessel has not reached the second reference temperature as a result of checking at step or operation 712, the controller 512 may continuously drive the timer to measure the elapsed time. When the temperature of the vessel has reached the second reference temperature as a result of the checking at step or operation 712, the controller 512 may stop the driving of the timer 710 at step or operation 714. Accordingly, the controller 512 may acquire a vessel determination time which is a time at which the vessel currently being heated reaches the second reference temperature from the first reference temperature.

The controller 512 may compare the acquired vessel determination time with the reference determination time to determine whether or not a load is present in the vessel which is currently being heated at step or operation 716. When it is determined that a load is present in the vessel as a result of the determination at step or operation 716, the controller 512 may continuously maintain the heating operation for the vessel. When it is determined that no load is present in the vessel as a result of determination at step or operation 716, the controller 512 may cut off the power supply to the working coil 518 to stop the heating operation for the vessel in step or operation 718. Accordingly, it is possible to prevent an unnecessary breaking phenomenon of the fuse occurring in a conventional process of preheating an empty vessel.

The controller 512 may measure the temperature of the vessel through the temperature sensor 516 while the heating operation for the vessel is continuously performed. The controller 512 may check whether or not the measured temperature of the vessel has reached a third reference temperature at step or operation 720.

When it is determined that the temperature of the vessel has not reached the third reference temperature as a result of the checking, the controller 512 may continuously maintain the heating operation for the vessel. When it is determined that the temperature of the vessel has reached the third reference temperature as a result of checking, the controller 512 may cut off the power supply to the working coil 518 to stop the heating operation for the vessel in step or operation 722, thereby preventing the vessel from being overheated.

Embodiments disclosed herein provide an induction heating device capable of determining whether or not a load is present in a vessel without a sensor, and a method for controlling an induction heating device. Embodiments disclosed herein further provide an induction heating device capable of preventing a phenomenon in which a fuse is broken resulting from a rapid rise in temperature of a vessel occurring in process in which a user preheats an empty vessel, and a method for controlling an induction heating device. Embodiments disclosed herein also provide an induction heating device capable of preventing a risk of fire resulting from a rise in temperature of a vessel in process that a user preheats an empty vessel, and a method for controlling an induction heating device.

Embodiments are not limited to the above-mentioned objects, and the other objects and advantages which are not mentioned can be understood by the following description, and more clearly understood by the embodiments. It will be also readily seen that the objects and the advantages may be realized by means indicated in the patent claims and a combination thereof.

As described above, in order to prevent a rapid rise in the temperature of the vessel occurring in process in which a user preheats an empty vessel using the induction heating device, and a fuse breaking phenomenon a resulting therefrom, a controller of an induction heating device according to embodiments may determine whether or not a vessel placed on a working coil is an empty vessel in a vessel heating process, that is, whether or not a load is present in the vessel. When it is determined that the vessel is an empty vessel, the controller may immediately cut off power supply to the working coil to stop the vessel heating operation, thereby preventing a phenomenon in which the fuse is broken and the vessel is overheated.

The controller of the induction heating device according to embodiments may check whether or not a temperature of the vessel has reached a first reference temperature, and when the temperature of the vessel has reached the first reference temperature, may measure time required for the temperature of the vessel to reach a second reference temperature. The time required for the temperature of the vessel to reach the second reference temperature from the first reference temperature may be defined as "vessel determination time".

The controller of the induction heating device according to embodiments may compare the vessel determination time with a predetermined reference determination time to determine whether or not the vessel placed on the working coil is an empty vessel. When the measured vessel determination time is equal to or less than the reference determination time, the controller may determine that the vessel placed on the working coil is an empty vessel. However, when the vessel determination time exceeds the reference determination time, the controller may determine that a load is present in the vessel placed on the working coil.

In the vessel heating process, the controller of the induction heating device according to embodiments may determine whether or not the vessel placed on the working coil is an empty vessel at a time point when the temperature of the vessel placed on the working coil reaches the second reference temperature. When it is determined that the vessel is an empty vessel, the controller may cut off the power supply to the working coil to stop the vessel heating operation.

At this time, the second reference temperature may be set to be much lower than a temperature at which the fuse is broken, that is, a breaking temperature. Therefore, the heating operation may be stopped at a time point when the temperature of the vessel reaches the second reference temperature so that the temperature of the vessel does not rise to the breaking temperature of the fuse even when the TEMPERATURE OF VESSEL rises due to heat energy remaining in the vessel. Accordingly, it is possible to prevent a fuse breaking phenomenon occurring in a conventional process of preheating a vessel.

Further, when the controller determines that the vessel is not an empty vessel, that is, that the vessel is not in a preheating state, the heating operation for the vessel may be maintained even when the temperature of the vessel exceeds the second reference temperature. In order to prevent the temperature of the vessel from rising excessively even when a load is present in the vessel, the controller may compare the temperature of the vessel with a third reference temperature to perform temperature control.

According to embodiments, it is possible to determine whether or not a load is present in the vessel placed on the induction heating device without a separate sensor. Further, according to embodiments, there is an advantage in that it is possible to prevent the fuse from being broken due to a rapid rise in the temperature of the vessel in process in which a user preheats an empty vessel using the induction heating device. Furthermore, according to embodiments, there is an advantage in that it is possible to prevent a risk of fire resulting from a rise in the temperature of the vessel occurring in process in which a user preheats an empty vessel using the inducting heating device.

As various substitutions, changes, and modifications can be made within the scope that does not deviate the technical idea for those skilled in the art to which embodiments pertains, embodiments are not limited by the above-mentioned embodiments and the accompanying drawings.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heating device, comprising:

a working coil;

a power supply unit configured to supply power to drive the working coil;

a fuse connected between the power supply unit and an external power source and broken when a breaking temperature is reached;

a temperature sensor configured to measure a temperature of a vessel placed on the working coil; and a controller configured to determine whether or not the vessel is an empty vessel based on a vessel determination time which is a time required for the temperature of the vessel measured by the temperature sensor to reach a second reference temperature from a first reference temperature, and to cut off power supply to the working coil performed by the power supply unit when it is determined that the vessel is an empty vessel, wherein the second reference temperature is set so that the temperature of the vessel rising due to heat energy remaining in the vessel after a heating operation for the vessel is stopped does not reach the breaking temperature.

2. The induction heating device of claim 1, wherein the controller determines that the vessel is an empty vessel when the vessel determination time is equal to or less than a predetermined reference determination time, and the controller determines that the vessel is not an empty vessel when the vessel determination time is greater than the predetermined reference determination time and determines that a load is present in the vessel.

3. The induction heating device of claim 2, wherein the reference determination time is set differently according to an output level of the induction heating device.

4. The induction heating device of claim 2, wherein when it is determined that a load is present in the vessel, the controller cuts off power supply to the working coil performed by the power supply unit when the temperature of the vessel reaches a third reference temperature.

5. The induction heating device of claim 1, wherein the first reference temperature is set to be higher than a boiling point of a predetermined reference load.

6. An induction heating device, comprising:

a case;

a cover plate disposed at an upper portion of the case;

a plurality of working coil assemblies disposed in the case, each including:

a working coil; and a temperature sensor configured to measure a temperature of a vessel placed on the respective working coil;

a power supply unit configured to supply power to drive the working coils;

a fuse connected between the power supply unit and an external power source and broken when a breaking temperature is reached; and a controller configured to determine whether or not the vessel is an empty vessel based on a vessel determination time which is a time required for the temperature of the vessel measured by the temperature sensor to reach a second reference temperature from a first reference temperature, and to cut off power supply to the respective working coil performed by the power supply unit when it is determined that the vessel is an empty vessel, wherein the second reference temperature is set so that the temperature of the vessel rising due to heat energy remaining in the vessel after a heating operation for the vessel is stopped does not reach the breaking temperature.

7. The induction heating device of claim 6, wherein the controller determines that the vessel is an empty vessel when the vessel determination time is equal to or less than a predetermined reference determination time, and the controller determines that the vessel is not an empty vessel when the vessel determination time is greater than the predetermined reference determination time and determines that a load is present in the vessel.

8. The induction heating device of claim 7, wherein the reference determination time is set differently according to an output level of the induction heating device.

9. The induction heating device of claim 7, wherein when it is determined that a load is present in the vessel, the controller cuts off power supply to the working coil performed by the power supply unit when the temperature of the vessel reaches a third reference temperature.

10. The induction heating device of claim 6, wherein the first reference temperature is set to be higher than a boiling point of a predetermined reference load.

11. The induction heating device of claim 6, further comprising:

an interface unit configured to receive input of an output level of the working coils from a user.

12. The induction heating device of claim 6, further comprising a timer configured to measure the time required for the temperature of the vessel measured by the temperature sensor to reach the second reference temperature from the first reference temperature.

13. The induction heating device of claim 6, wherein the cover plate includes a top plate having a plurality of burner areas corresponding to the plurality of working coil assemblies and a control area corresponding to the interface unit.

14. The induction heating device of claim 13, wherein each of the working coil assemblies further includes:

a coil base;

first and second working coils disposed on the coil base;

a plurality of connectors that connect the first and second working coils to at least one of the power supply unit or the controller; and the temperature sensor.

15. The induction heating device of claim 14, wherein the temperature sensor and the fuse are disposed to be in contact with a lower surface of cover plate.

* * * * *